United States Patent [19]

Taylor et al.

[11] Patent Number: 4,836,626

[45] Date of Patent: Jun. 6, 1989

[54] KNOCK-DOWN CABINET

[75] Inventors: Homer L. Taylor, Centerville; Peter Katz, Nashville, both of Tenn.

[73] Assignee: Tennsco Corporation, Dickson, Tenn.

[21] Appl. No.: 182,376

[22] Filed: Apr. 15, 1988

[51] Int. Cl.[4] ..... A47B 43/00

[52] U.S. Cl. ..... 312/257 SM; 312/263; 312/324; 312/257 R

[58] Field of Search ..... 312/257 R, 257 SM, 257 A, 312/263, 324, 292; 220/4 F

[56] References Cited

U.S. PATENT DOCUMENTS

| | | | |
|---|---|---|---|
| 2,265,618 | 12/1941 | Adams | 220/4 F |
| 2,571,622 | 10/1951 | Schmidt | 312/263 |
| 2,802,487 | 8/1957 | Breehl | 312/257 SM |
| 3,360,321 | 12/1967 | Novales | 312/263 X |
| 3,672,531 | 6/1972 | Balven | 220/4 F |
| 4,077,686 | 3/1978 | Bukaitz | 312/257 SM |
| 4,201,428 | 5/1980 | Johnson | 312/257 R |
| 4,288,132 | 9/1981 | Znamirowski et al. | 312/257 SM |
| 4,289,363 | 9/1981 | Andersson | 312/199 X |
| 4,295,693 | 10/1981 | Viklund | 312/257 R |
| 4,462,647 | 7/1984 | Key | 312/257 R X |

*Primary Examiner*—Joseph Falk

*Attorney, Agent, or Firm*—Harrington A. Lackey

[57] ABSTRACT

A knock-down cabinet including a rear wall having forward projecting side flanges, a top wall having downward projecting side flanges, and a pair of opposed side walls having inboard projecting connector flanges for receiving the respective side flanges of the rear and top walls in an assembled position. The cabinet also includes a front door frame assembly having special shoulder bolt and slot connectors for assembly upon the front edge portions of the side walls, and one or more shelves received within the cabinet. The entire assembly of the cabinet is conducted with a minimum number of press-fitted plugs for assembly without tools within a minimum of time by unskilled labor.

10 Claims, 6 Drawing Sheets

KNOCK-DOWN CABINET

BACKGROUND OF THE INVENTION

This invention relates to a knock-down cabinet, and more particularly to a knock-down cabinet capable of being assembled by unskilled labor with a minimum of fasteners and without tools.

Knock-down cabinets of various types are known in the art, and some of these knock-down cabinets may be easily assembled without any special fasteners or tools or with a minimum of fasteners and tools, as illustrated in the following U.S. patents:

| | | |
|---|---|---|
| 2,571,622 | Schmidt | Oct. 16, 1951 |
| 3,360,321 | Novales | Dec. 26, 1967 |
| 3,672,531 | Balven | Jun. 27, 1972 |
| 4,077,686 | Bukaitz | Mar. 7, 1978 |
| 4,289,363 | Andersson et al | Sep. 15, 1981 |
| 4,295,693 | Viklund | Oct. 20, 1981 |
| 4,462,647 | Key | Jul. 31, 1984 |

The Adams U.S. Pat. No. 2,265,618, issued Dec. 9, 1941, discloses a collapsible container in which the bottom, side and end walls are assembled by interconnecting flanges and tongues.

U.S. Pat. No. 2,802,487, issued to Breehl on Aug. 13, 1957, discloses an interconnecting joint along the seam of an air conditioner duct in which the joint includes an elongated flange on one wall received within the slot formed by a retainer flange on an adjacent wall.

The above cited Novales Pat. No. 3,360,321, utilizes interconnecting shoulder studs and key-ways for assembling adjacent walls or panels in a knock-down locker structure.

The patents to Novales, Andersson et al, Viklund, and Key disclose cabinets including separable front door frames and door assemblies.

SUMMARY OF THE INVENTION

The knock-down cabinet made in accordance with this invention includes a plurality of separate elements or parts, namely a back or rear wall, a pair of side walls, a top wall, a front door frame assembly, and one or more shelves, which are adapted to be assembled in a certain sequence and held in assembled position with a minimum number of plastic plugs, without the use of tools by unskilled labor.

The cabinet made in accordance with this invention incorporates a rear panel having a pair of forwardly projecting side flanges, a top wall having a pair of side depending flanges, and a pair of opposed side walls having special retainer flanges mounted along their rear edges for receiving the side flanges of the rear wall and a pair of similarly constructed top retainer flanges for receiving the side flanges of the top wall. The front door frame is adapted to be connected to the front edges of the side walls by cooperating shoulder studs and slots, and all of the walls and door frame are secured together by a bottom wall or shelf secured to the bottom portion of the front door frame by a press-fitted plastic plug member. Other plug members are utilized for stabilizing the assembly of the walls. A plurality of shelves may be mounted at vertically spaced intervals within the cabinet by support of their marginal depending flanges upon upward projecting tongues fixed on the interior surfaces of the side and rear walls. Hinged doors are pre-fabricated in the front frame to facilitate assembly of the cabinet.

In the assembly of the knock-down cabinet made in accordance with this invention, no bolts or nuts, or any other fasteners requiring conventional or special tools are utilized.

The cooperating flange connectors between the side walls and the rear wall, permit the side walls to be assembled by pivoting each side wall from a substantially parallel position in front of the rear wall to an assembled position projecting forwardly at right angles to the rear wall. The top wall is assembled by sliding it rearwardly from the front along the top edge portions of the side walls until the rear edge of the top wall engages the rear wall, and its cooperating connectors are fully engaged., The front frame is provided with upper shoulder studs which are inserted into a pair of opposed key-ways. The front door frame is then swung downward causing other lower vertically spaced shoulder studs to fit into engagement with corresponding forwardly opening slots in the front edge portions of the side walls. A bottom wall or shelf having depending marginal flanges is fitted into corresponding tongues in the rear wall and/or the interior of the side walls and fitted over a corresponding upward projecting transverse flange along the bottom sill of the door frame. At least one plastic plug is inserted through a corresponding hole in the bottom sill in the front of the bottom shelf for securing all of the walls and front frame together. Plastic plug members are also preferably inserted through the top of the door frame for connection with the top wall, and rear plastic plugs are inserted through the rear flanges of the side walls and the rear wall.

BRIEF DESCRIPTION OF THE DRAWINGS

FIG. 2 is a fragmentary plan section taken along the line 21—21 of FIG. 19;

DESCRIPTION OF THE PREFERRED EMBODIMENTS

Figure 18:
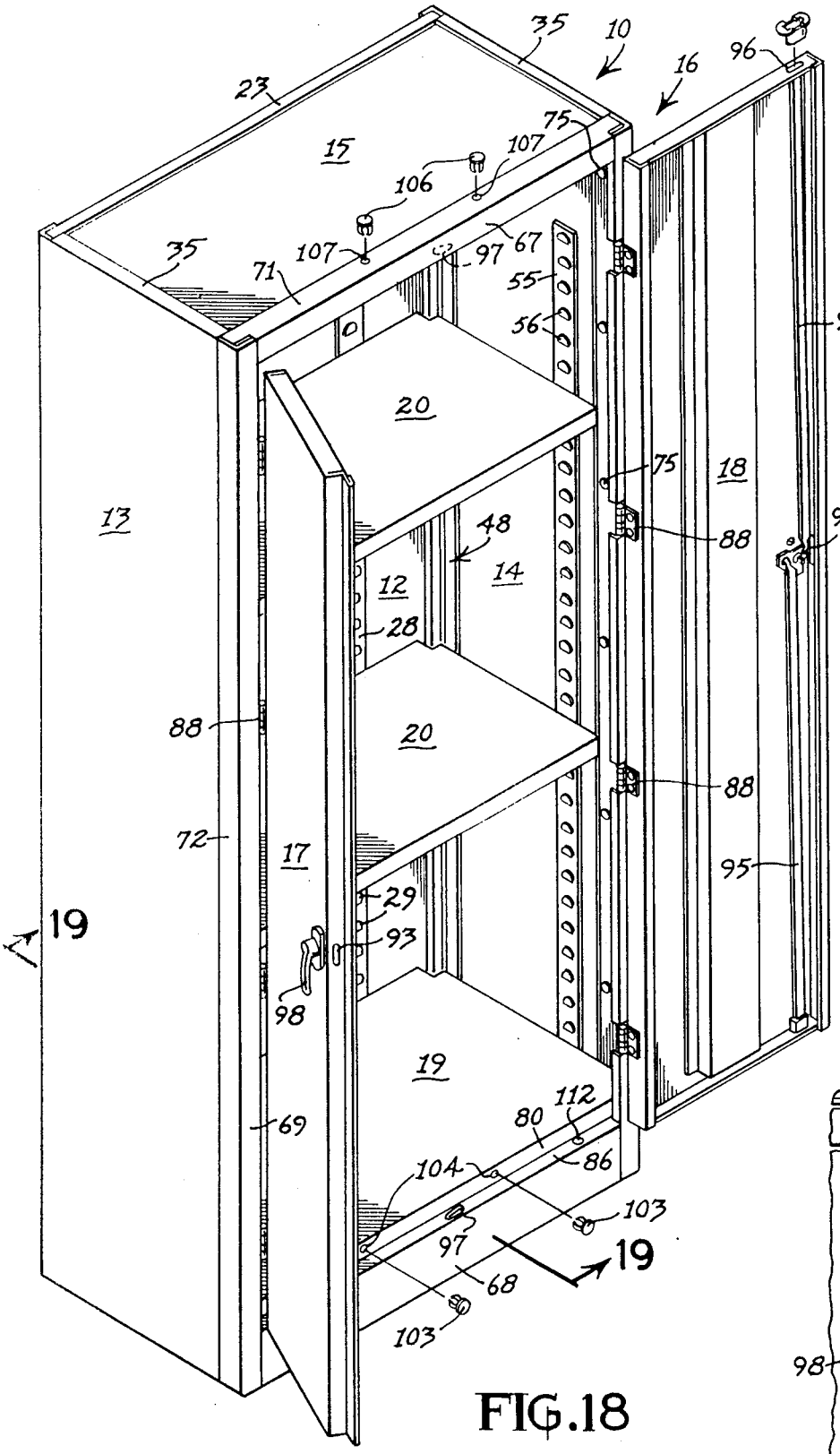
FIG. 18 is a top, front, left side perspective view of the assembled cabinet, with the doors open, and with the bottom shelf and two upper shelves assembled within the cabinet and preparatory to insertion of some of the plug members.
Figure 24:
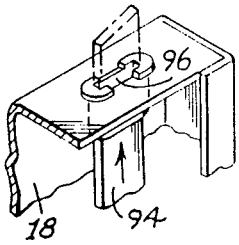
FIG. 24 is a top fragmentary sectional perspective view of the upper portion of the right door illustrating the operation of the upper locking bar.
Figure 23:
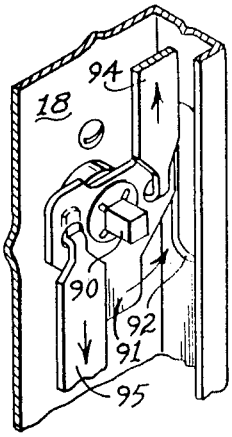
FIG. 23 an inside, perspective, fragmentary sectional view of the inside of the door handle locking mechanism in an unlocked position.
Figure 22:
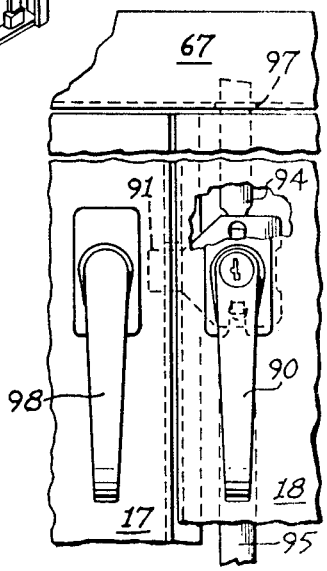
FIG. 22 is a fragmentary front elevational view of the door locking mechanism in a locked position.
Figure 25:
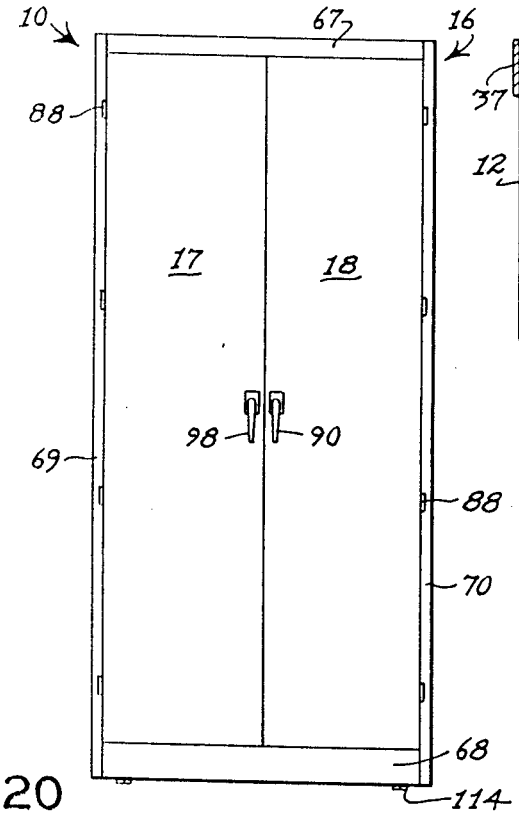
FIG. 25 is a front elevational view of the knock-down cabinet made in accordance with this invention, fully assembled and with the doors closed.
Figure 20:
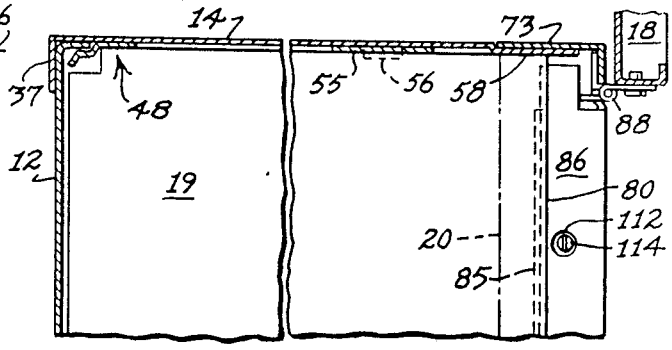
FIG. 20 a fragmentary sectional plan view of the lower portion of the right-hand side of the cabinet taken along the line 20—20 of FIG. 19.
Figure 21:
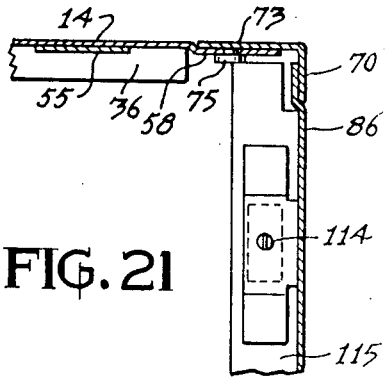

A knock-down cabinet 10 made in accordance with this invention, and disclosed in its assembled position in FIGS. 18 and 25, includes a rear or back wall 12, a pair of side walls 13 and 14, a top wall 5, a front door frame assembly 16, including front doors 17 and 18, a bottom shelf or wall 19 and a plurality of adjustable upper shelves 20.

The rear wall 12 is preferably rectangular having an inside or front surface 21 and an outside or rear surface 22, and having a longitudinal upright dimension and a transverse dimension. The top, bottom, and side edges of the rectangular rear wall 20 terminate in an inward or forward projecting top flange 23, bottom flange 24, left side flange 25, and right side flange 26, each of which projects at approximately right angles to the plane of the rear wall 12 and preferably at substantially the same distance from the inside surface 21 of the rear wall 12.

Secured upon the inside surface 21 of the rear wall 12 are a pair of upright substantially parallel shelf retainer strips 27 and 28, each of which is provided with upwardly projecting, vertically spaced, shelf retainer tongues 29.

Figures 1, 2, 3, 4, 5:
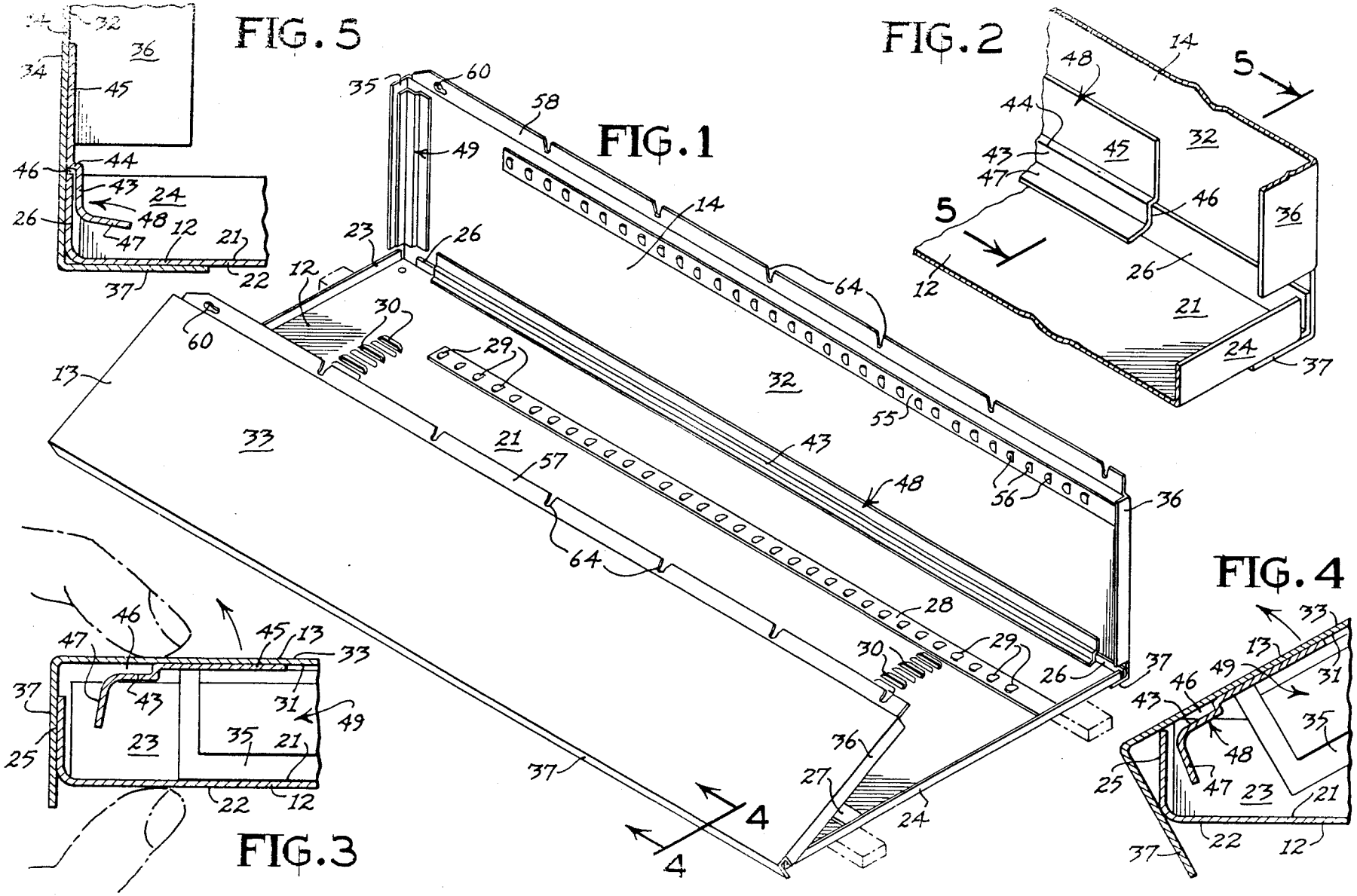
FIG. 1 is a front, bottom perspective view of the rear wall of the knock-down cabinet made in accordance with this invention lying down upon its rear surface, with the right side wall assembled upon the rear wall and the left side wall in a pre-assembled position.
FIG. 2 is an enlarged fragmentary view of the lower right-hand portion of the assembled rear wall and right side wall, illustrated in FIG. 1.
FIG. 3 is an enlarged fragmentary sectional elevation of the left hand portion of the rear wall and the left side wall in their initial cooperating position preparatory to assembly.
FIG. 4 is an enlarged fragmentary sectional elevation taken along the line 4—4 of FIG. 1, of the left side wall and the rear wall in an intermediate assembled position.
FIG. 5 is a section taken along the line 5—5 of FIG. 2.
Figures 6, 7, 8, 9:
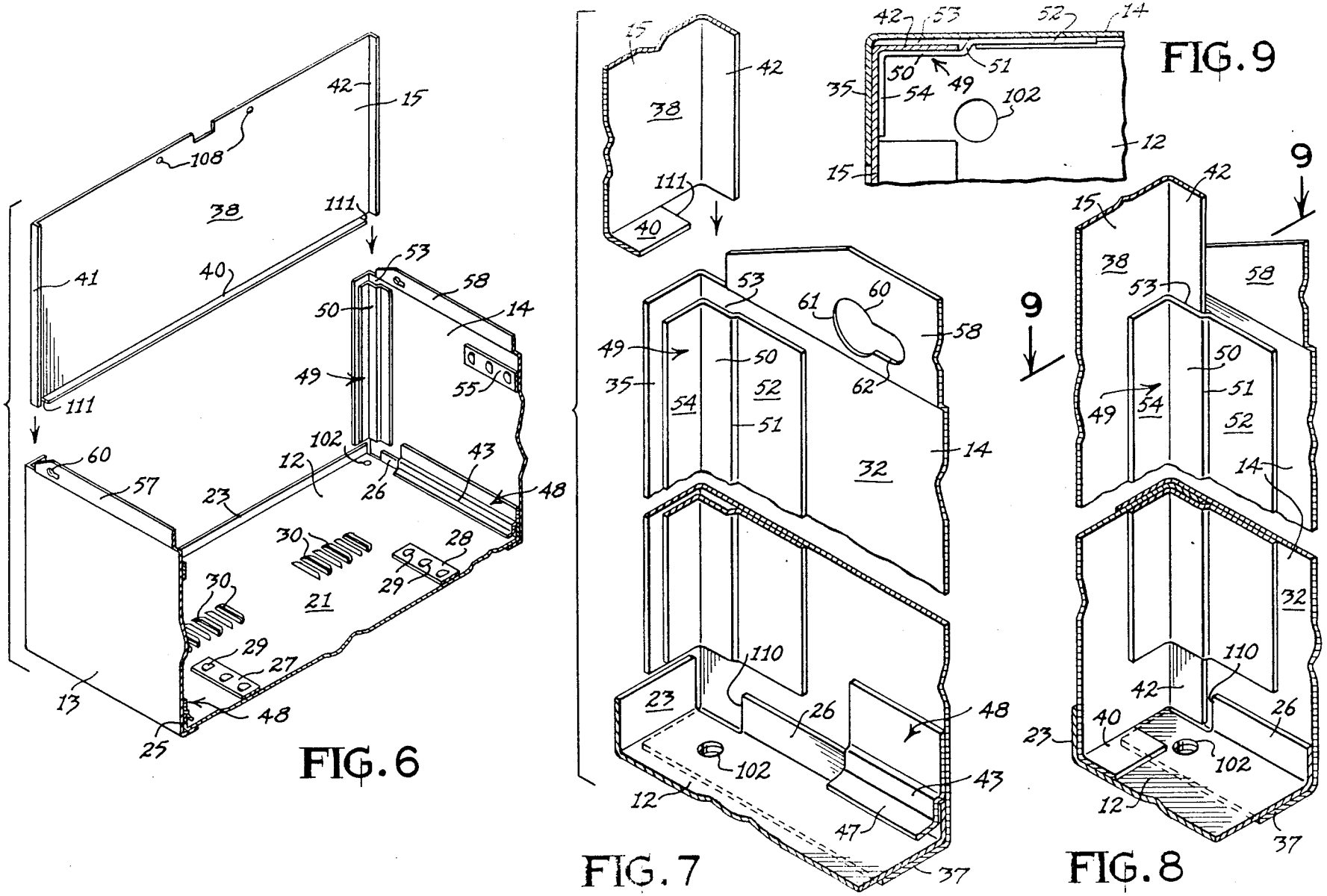
FIG. 6 fragmentary perspective view of the upper portion of the assembled rear wall and side walls, with the top wall in a position preparatory to assembly.
FIG. 7 is an enlarged fragmentary perspective interior view of the upper right hand portion of the rear wall, right side wall and wall illustrated in FIG. 6.
FIG. 8 is a fragmentary sectional perspective view of the right wall rear wall, and top wall, illustrated in FIG. 7, with the wall assembled.
FIG. 9 is a fragmentary section taken along the line 9—9 of FIG. 8.

Also, if desired, ventilating louvers 30 may be formed through the rear wall 12, as illustrated in FIGS. 1 and 6.

Each side wall 13 and 14 is also rectangular and of equal size and dimensions, and each having a height or upright dimension substantially equal to the upright dimension of the rear wall 12.

Each side wall 13 and 14 has a corresponding inside surface 31 and 32 and a corresponding outside surface 33 and 34, respectively.

The remaining corresponding parts of the side walls 13 and 14, to be described, bear the same reference numerals, since these parts will be identical, except that they are the mirror image of each other when assembled.

Each of the side walls 13 and 14 have their top and bottom edges and their rear edge terminating in corresponding inboard projecting top flange 35, bottom flange 36, and rear flange 37. Each of the top and bottom flanges 35 and 36 extend continuously from the front portion of each corresponding side wall 13 and 14 rearwardly, but preferably terminate a short spaced distance from the rear edge and rear flange 37 of each corresponding side wall 13 and 14. On the other hand, the rear flange 37 extends substantially the full upright distance of each of the corresponding side walls 13 and 14.

The top wall 15 is also rectangular, having a longitudinal dimension substantially equal to the width of the rear wall 12 and having a front-to-rear dimension, or width, substantially equal to the width of each of the corresponding side walls 13 and 14. The top wall 15 has a bottom surface 38 and a top surface 39. The rear and side edges of the top wall 15 terminate in a corresponding depending rear flange 40 and opposed depending side flanges 41 and 42. Each of the flanges 40, 41, and 42 depend substantially the same distance Fixed to the rear portion of the inside surface 32 of each of the side walls 13 and 14 is an elongated upright rear retainer flange member 48 including an elongated upright retainer flange 43 connected by a connector portion 44 to a base strip 45 fixed to the inside surface 32 of each of the side walls 13 and 14, such as by welding. The retainer flange 43 is generally parallel to, but offset inward, from the base strip 45 and defines with the inside surface 32 of the side wall, a slot 46 opening rearward. The connector portion 44 closes the front end of the slot 46. The rear portion of the retainer flange 43 preferably terminates in a flared lip 47. The entire retainer flange member 48 including the retainer flange 43, closed end connector portion 44, the base strip 45, and the lip 47 are preferably formed from a single piece of sheet metal by an appropriate bending or stamping die to assume the shape generally disclosed in FIGS. 1-5. As best disclosed in FIGS. 3, 4 and 5, the rear opening slot 46 is spaced forwardly of the rear flange 37 a sufficient distance to permit either of the corresponding side flanges 25 and 26 to be guided and cammed by the lip 47 into the open end of the slot 46. The side flange 25, 26 is retained in its finally assembled position within the slot 40 between the rear retainer flange 43 and the rear portion of the corresponding side wall 13 or 14, as best disclosed in FIG. 5, with the rear wall 12 engaging the rear flange 37 of the corresponding side wall 13 and 14.

Fixed to the top edge portion of each of the interior surfaces 32 of the side walls 13 and 14 is a top retainer flange member 49 of similar construction to the side flange retainer member 48. The top retainer flange member 49 includes a top retainer flange 50 connected by a closed end connector portion 51 to a base strip 52 fixed, such as by welding, to the top edge portion of each of the interior surfaces 32 of the side walls 13 and 14. Each of the top retainer flanges 50 is substantially parallel to and offset inwardly from the base strip 52 and the corresponding side wall 13 and 14, and defines an upper slot 53 opening upward, and also terminates in a substantially horizontally, inwardly projecting lip 54. It will be noted, particularly in FIGS. 7, 8, and 9, that the top lip 54 is not flared as the rear lip 47, but extends at substantially right angles to the top retainer flange 50 and parallel to the top flange 35, so that the depending side flanges 41 and 42 of the top wall 15 are received in the corresponding slots 53 while the main body of the top wall 15 is received between the top lips 54 and the top flanges 35 of the respective side walls 13 and 14, when the top 15 is assembled with the side walls 13 and 14, as disclosed in FIGS. 6–9. As disclosed particularly in FIG. 9, the lip 54 is spaced close enough to the top flange 35 that the body of the side wall 15 is snugly, but slidably received between the lip 54 and the top flange 35.

The interior surface 32 of each of the side walls 13 and 14 is also provided with an elongated upright shelf retainer strip 55 provided with longitudinally or vertically spaced upward projecting shelf retainer tongues 56. The shelf retainer tongues 56 are spaced so that corresponding opposed tongues mounted on the opposite walls 13 and 14 are at the same level for supporting the shelves 20 in corresponding level or horizontal positions within the cabinet 10.

The front edge portion of each of the side walls 13 and 14 terminates in corresponding forward projecting front connector flanges 57 and 58 slightly indented inward from the plane of the corresponding side walls 13 and 14. Each of the front connector flanges 57 and 58 is provided with a key-way 60 adjacent its top edge portion, having an enlarged circular upper portion 61 and a more narrow depending slot portion 62.

Figure 16:
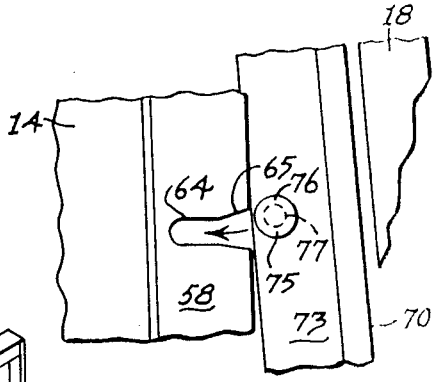
FIG. 16 is fragmentary sectional elevation of the lower portion of the door frame and right side wall illustrated in FIG. 13, preparatory to a lower shoulder stud being inserted into its corresponding slot, when the top shoulder stud is locked in its key-way in the position disclosed in FIG. 14.

Spaced at longitudinal intervals along each of the corresponding front connector flanges 57 and 58 are a plurality of slots 64 which open forwardly and are provided with upwardly and forwardly flared cam surfaces 65, (FIG. 16).

Figure 13:
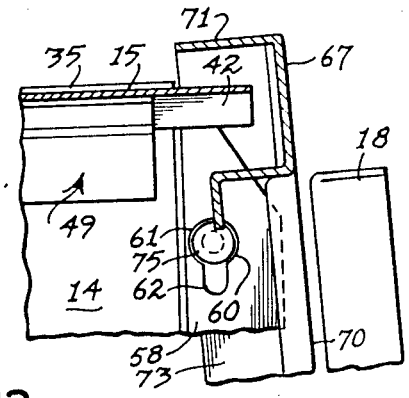
FIG. 13 is a fragmentary sectional elevation taken along the line 13—13 of FIG. 12, with the upper portion of the door frame in a pre-assembled position upon the right side wall, illustrating the top shoulder stud inserted through the upper portion of the corresponding key-way.

The door frame assembly 16 includes an elongated top transverse frame member 67, a bottom sill member 68 and a pair of upstanding side frame members 69 and 70. The top frame member 67 is provided with a horizontal top flange 71 projecting rearwardly, which fits over the front edge portion of the top wall 15, when the cabinet 10 is fully assembled, (FIGS. 13 and 14).

Each of the side frame members 69 and 70 is provided with an upright rearward projecting connector flange 72 and 73 to each of which is fixed inwardly projecting longitudinally spaced shoulder studs 75. Spacing between the shoulder studs 75 is identical to the spacing between the key-way 60 and the slots 64 on each of the corresponding front connector flanges 57 and 58 respectively.

The heads 76 of each of the shoulder studs 75 is preferably circular and of a smaller diameter than the enlarged circular opening 61 in each of the key-ways 60 to permit insertion of the shoulder studs 75 through the enlarged circular opening 61. The head 76 of each shoulder stud 75 is larger than the transverse dimension of the depending slot portion 62 of each key-way 60. However, the shank 77 of the shoulder stud 75 is small enough to be received in the depending slot portion 62, as illustrated in FIG. 14, (FIG. 16).

Figure 14:
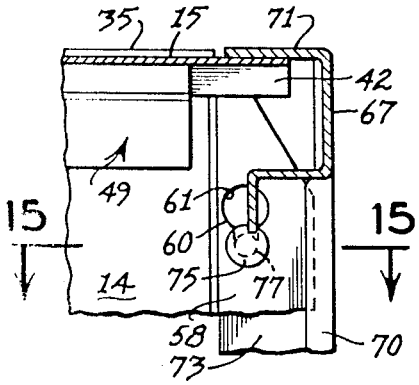
FIG. 14 is a sectional elevation similar to FIG. 13, illustrating the top shoulder stud dropped into the lower portion of the corresponding key-way.
Figure 15:
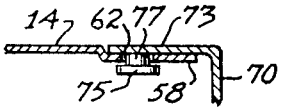
FIG. 15 is a fragmentary section taken along the line 15—15 of FIG. 14.

The spacing between the key-way 60 and the next lower open slot 64 is such that when the shoulder stud 75 has been inserted into the key-way 60 and then lowered into locking reception with the narrow depending slot portion 62, each of the lower shoulder studs 75 register with the openings in the slots 64, so that they may be inserted and received within the corresponding slots 64, with the shank portion 77 camming against the upper cam portion 65, if necessary, and as best disclosed in FIGS. 14 and 16.

The bottom wall or shelf 19 and each of the upper adjustable shelves 20 is rectangular and of a size and shape to be received horizontally and in vertically spaced relationship within the assembled cabinet 10. Each of the shelves 19 and 20 terminate at their edges in corresponding depending front flanges 80, rear flanges 81, and opposed side flanges 82 and 83.

Figure 19:
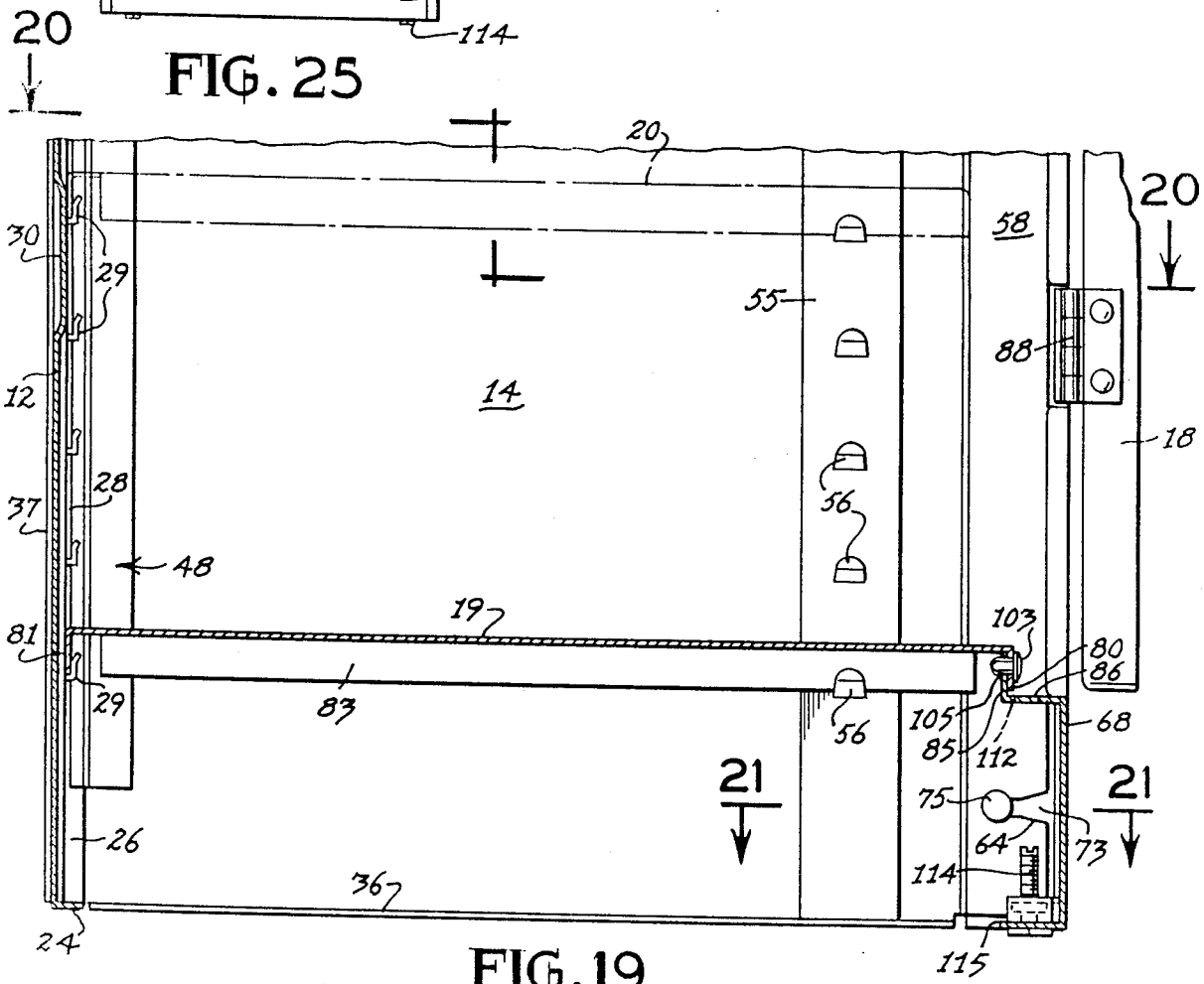
FIG. 19 an enlarged fragmentary sectional elevation of the lower portion of the cabinet taken along the line 19—19 of FIG. 18.

The bottom sill 68 is provided with an inwardly offset, upstanding, transverse, top vertically extending flange 85 which, as illustrated in FIG. 19, is adapted to support the front edge portion of the bottom shelf 19, with the front flange 80 of the bottom shelf 19 overlapping the upstanding flange 85. The vertical upstanding connector flange 85 is connected to the main portion of the sill 68 by the transverse top ledge 86. Thus, when the cabinet 10 is fully assembled, the bottom shelf 19 is fully supported along its front edge portion by the transverse vertical connector flange 85, by its rear flange 81 being received in the rear tongues 29 and its side flanges 82 and 83 being fully received within the corresponding retainer tongues 56, as illustrated in FIGS. 18 and 19.

Connected to the side frame members 69 and 70 by vertically spaced door hinges 88 are the front doors 17 and 18.

The door 18 may be provided with a handle member 90 having a door latch 91 adapted to be rotated to be received through the slots 92 and 93 of the opposite doors 18 and 17, respectively. The door handle member 90 may also be connected to upper and lower latch bars 94 and 95, respectively, adapted to extend through corresponding latch openings 96 in the top ledges of the door 18 and latch openings 97 in the top and bottom frame members 67 and 68, respectively. A dummy handle 98 may be rigidly attached to the opposite door 17.

The elements of the cabinet 10, including the rear wall 12, the side walls 13 and 14, the top wall 15, the pre-assembled door frame assembly 16, and the shelves 19 and 20 are shipped and/or stored in their separate disassembled knock-down condition.

In order to assemble the various elements, the rear wall 12 is preferably placed upon the floor with its rear surface 22 down, and preferably upon a pair of boards or corrugated packing pads 100, disclosed in phantom in FIG. 1. The side walls 13 and 14 are first assembled or connected to the rear wall 12 by placing each of the side walls 13 with its inside surface 32 down upon the front surface 21 of the rear wall 12, as illustrated in FIGS. 1 and 3. As illustrated in FIG. 3, the rear flange 37 is placed over the now upstanding side flange 25 of the rear wall 12. While holding the flanges 37 and 25 together, with one hand of the operator, the other hand lifts the front edge portion of the side wall 33, as illustrated in FIGS. 1 and 4, causing the side flange 25 to slide over the lip 47 and into the slot 46 between the rear retainer flange 43 and the inside surface 31 of the side wall 13. The side wall 13 is gradually pivoted upwardly until the side wall 13 is normal or at right angles to the back wall 12 and in the same relative position as illustrated in FIGS. 2 and 5 disclosing the assembled position of the other side wall 14.

In like manner, the side wall 14 is placed with its inside surface 32 down upon and facing the inside surface 21 of the back wall 12, and the side wall 14 is gradually pivoted upward, causing the side flange 26 to slip within the open slot 46 between the rear retainer flange 43 and the opposite side wall 14 until it is in its fully assembled position disclosed in FIGS. 1, 2 and 5.

Figure 10:
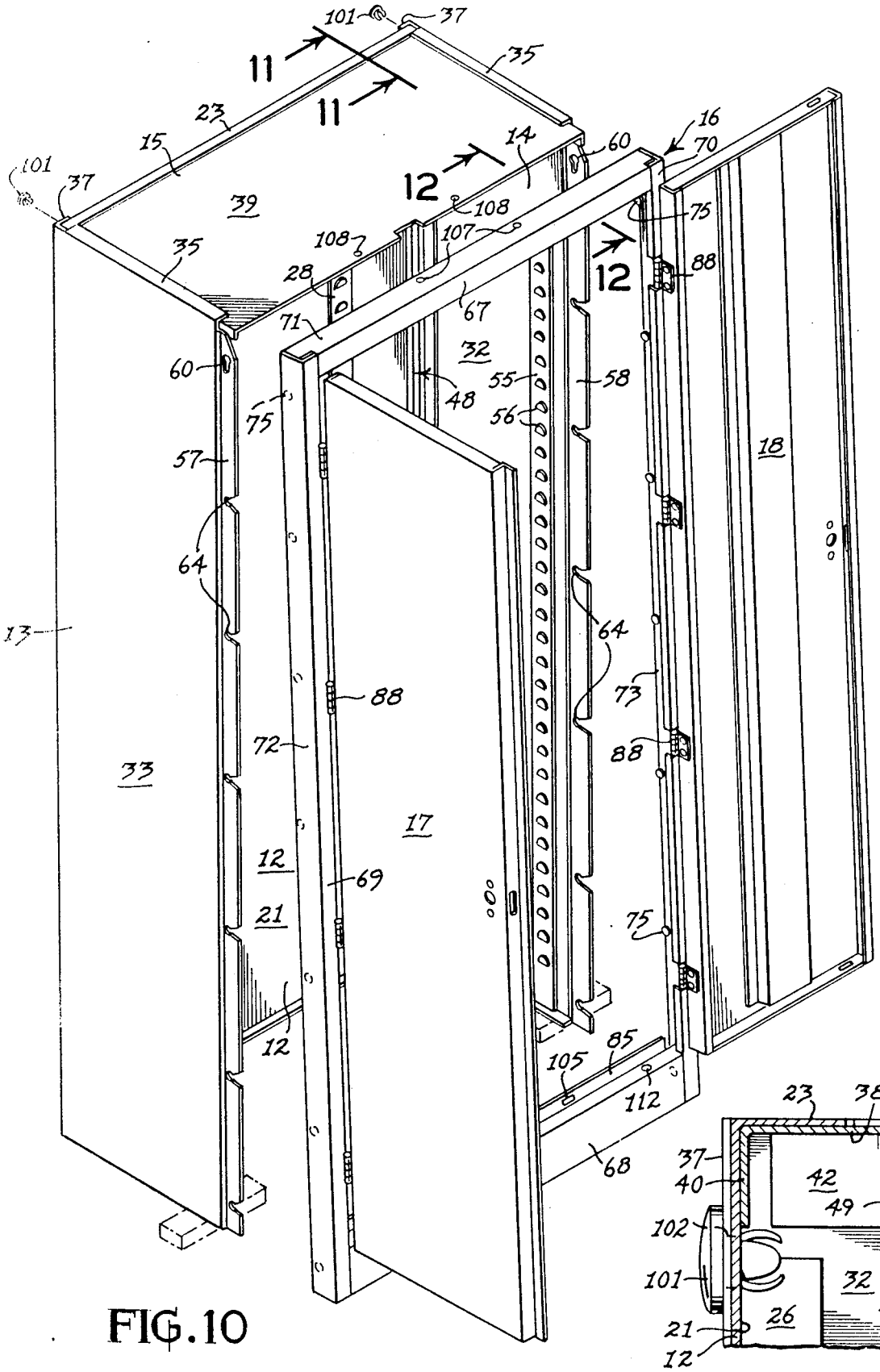
FIG. 10 is a top, front, right side perspective view of the fully assembled rear, side and top walls, illustrating the front door frame positioned preparatory to assembly with the front of the side walls.

With both side walls 13 and 14 fully assembled at right angles to the rear wall 12, and with the rear wall 12 still lying flat upon the floor, as illustrated in FIG. 6, the top wall 38 is then introduced from the front of the cabinet 10, that is, it is lowered in the direction of the arrows in FIG. 6. The side flanges 41 and 42 of the top wall 15 slide downwardly between the top retainer flanges 50 and their corresponding side walls 13 and 14, as illustrated in FIGS. 7 and 8, until the rear flange 40 abuts flush against the inside surface 21 of the rear wall 12, as illustrated in FIGS 8 and 9. With the side walls 13 and 14, rear wall 12, and top wall 15 fully assembled, as illustrated in FIG. 10, the partially assembled cabinet is lifted to its upright position as disclosed in FIG. 10. A pair of plastic plugs 101 may then be inserted through corresponding holes 102 in the rear flanges 37 into corresponding holes in the back wall 12. Thus, the side and rear walls are fastened together primarily for stability, since the interlocking connections between the side, rear, and top walls through their cooperating flanges and retainer flanges will normally lock these parts in place.

Figure 12:
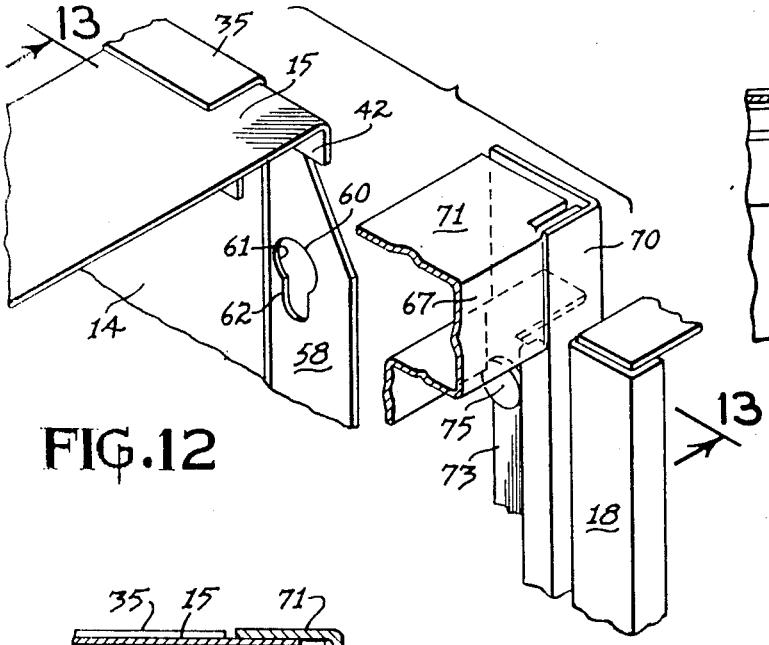
FIG. 12 is an enlarged exploded, perspective view of the upper right-hand front portion of a cabinet taken along the line 12—12 of FIG. 10.

As illustrated in FIG. 10, the front door frame assembly 16, with its pre-assembled hinged doors 17 and 18 is moved rearward toward the pre-assembled cabinet walls, and the top shoulder studs 75 are inserted from the outside through their corresponding key-ways 60, as illustrated in FIGS. 12 and 13. Then the door frame assembly 16 is lowered until the top shoulder studs 75 are locked in the lower depending slot portions 62 of each key-way 60, as illustrated in FIG. 14. Then the door frame assembly 16 is rotated downward and inward, causing the remaining shoulder studs 75 to cam into their respective open slots 64.

Figure 17:
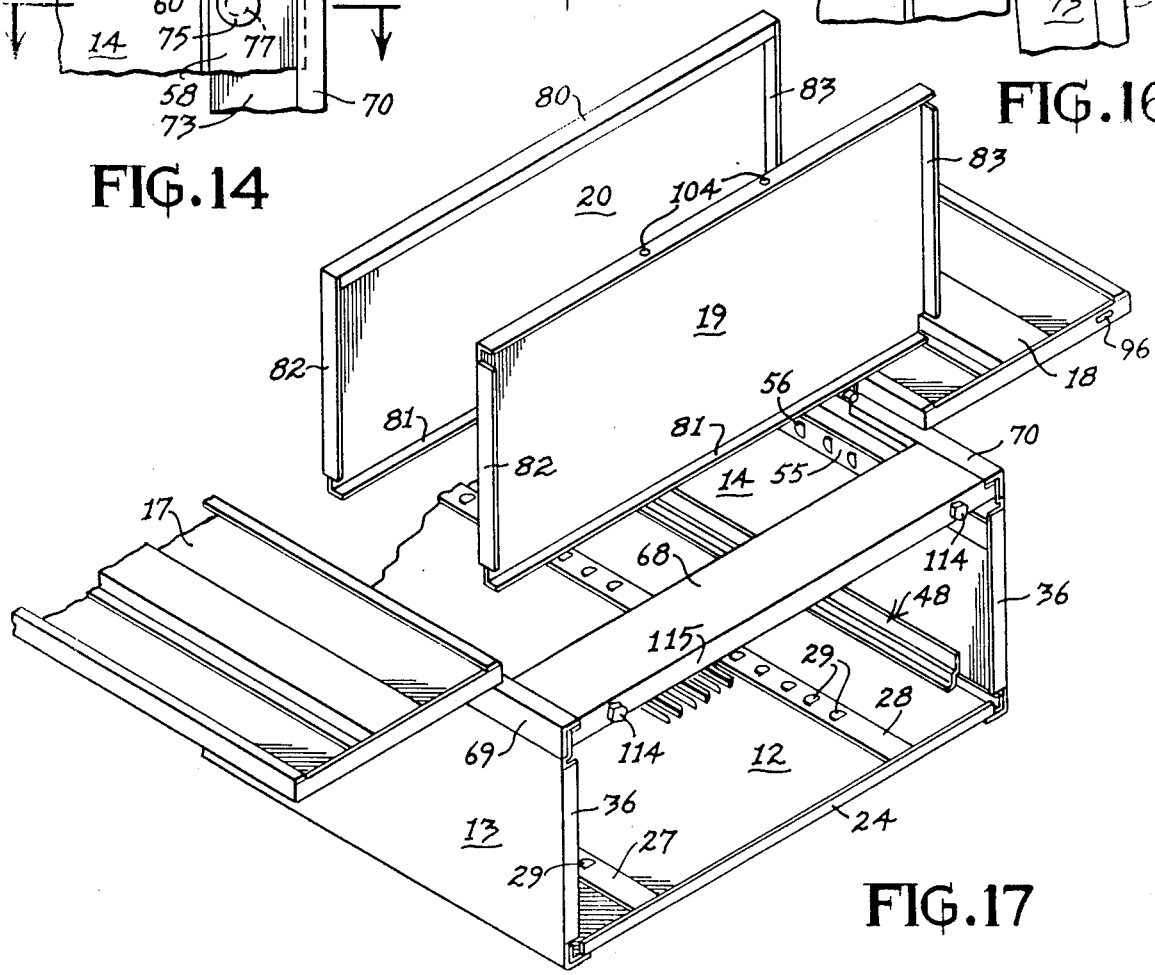
FIG. 17 is a fragmentary front, left side perspective review of the lower portion of the cabinet lying upon its back after the front door frame has been assembled upon the corresponding side walls, and with the doors open, preparatory to insertion of the bottom shelf and an upper shelf.

As illustrated in FIG. 17, the bottom shelf 19 is then inserted into the open cabinet over the bottom sill 68 and the respective flanges 81, 82, and 83 are lowered into their respective retainer tongues 29 and 56, and the front flange 80 is lowered over the upstanding sill flange 85. One or more plastic plugs 103 are inserted through corresponding holes 104 and 105 in the corresponding front depending flange 80 and the upstanding connector flange 85 to lock the bottom shelf 19 in position and also to lock the entire cabinet parts in their fully assembled position.

If desired, as illustrated in FIGS. 10 and 18, the plastic plugs 106 may be inserted through corresponding holes 107 in the top flange 71 and then through corresponding holes 108 in the front edge portion of the top wall 15 to further stabilize the top wall 15.

Figure 11:
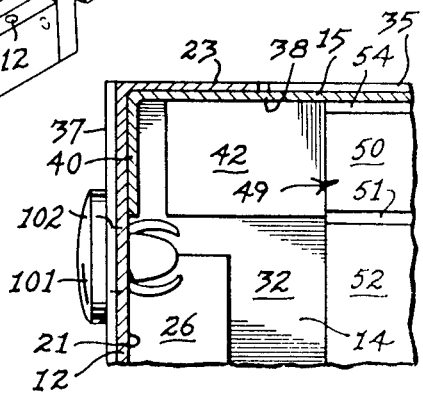
FIG. 11 is an enlarged fragmentary section taken along the line 11—11 of FIG. 10, with the corresponding plastic plug inserted.

The plastic plug members 101 disclosed in FIG. 11, may be identical to all of the other plastic plug members 106 and 103. Each plastic plug member may have plastic expansible shanks, as illustrated in FIG. 11, so that the plug member may be snugly manually inserted into its corresponding hole and be retained in place unless forcefully removed.

It has been found that even though six plastic plugs 101, 103, and 106 have been disclosed for insertion into corresponding holes in various parts of the cabinet 10, nevertheless, only a single plastic plug 103 inserted through its hole 104, is required in order to lock all of the walls and door frame in position. The remaining plastic plugs are merely for stabilization and to prevent rattling, which might occur if tolerances are not very close and where gauge parts are thin enough to permit flexing of the sheet metal parts.

As best disclosed in FIGS. 6–8, the side flanges 25 and 26 must not extend the full height of the rear wall 12, and must terminate, particularly at its upper end to form a gap 110, between the top end of the flange 26 (25) and the top flange 23 so that the side flange 42 of the top wall 15 may descend its full depth to the surface of the rear wall 12, as disclosed in FIG. 8. Furthermore, there must be a gap 111 between the ends of the rear flange 40 of the top wall 15 and their respective side flanges 41 and 42 so that the flanges 42 may slide freely within the corresponding slots 53 and the lips 54 may slide within the corresponding slots 111, as best disclosed in FIGS. 6 and 7.

Although various parts have been described as having the same height or the width, nevertheless, there will be insufficient variation in such lengths and widths to permit overlapping of corresponding flanges between the respective walls.

After the cabinet 10 is fully assembled, and in an upright position upon the floor, a screwdriver may be inserted down through an opening 112 in the ledge 86 of the sill 68 to engage a kerf in a leveling screw 114 fitted into a bottom flange 115 of the sill 68 in order to properly level the cabinet 10.

It will therefore be seen that a knock-down cabinet 10 has been constructed which may be easily assembled and disassembled with a minimum of a single plastic plug 103, without the use of any nuts or bolts or any other fasteners requiring tools, and without skilled labor. Moreover, the parts of the cabinet 10 may just as easily be disassembled and stacked for storage or shipment in a minimum of space, and in a minimum of time.

What is claimed is:

1. A knock-down cabinet comprising:

(a) a rear wall having front and rear surfaces, top and bottom edges and opposite sides terminating in forward projecting, upright side flanges, (b) a pair of said walls, each side wall having top, bottom, front, and rear edge portions and inside and outside surfaces, an upright rear flange projecting inboard from each said rear edge portion, and a top flange projecting inboard from each said top edge portion, (c) a rear retainer flange mounted on and spaced from said inside surface of each of said side walls adjacent said rear edge portion to form a rear retainer slot opening rearward and spaced from said rear flange on said corresponding side wall to receive said corresponding side flange in an operative assembled position, (d) a top retainer flange mounted on and spaced from said inside surface of each of said side walls adjacent said top edge portion to form a top retainer slot opening upward and spaced from said top flange of said corresponding side wall, (e) a top wall, having top and bottom surfaces, front and rear edge portions and opposite sides terminating in depending side flanges adapted to be received in said top retainer slots in said operative assembled position, (f) each of said front edge portions of said corresponding side walls comprising an elongated front connector strip having opposite end portions, (g) a key-way in one end portion of each of said front connector strips, (h) a door frame having a pair of upright side frame members, (i) a shoulder stud projecting inboard from each of said side frame members for insertion and engagement in a corresponding key-way in said one end portions of said front connector strips, and (j) means for securing said door frame to said side walls in said operative assembled position.

2. The invention according to claim 1 in which each of said rear retainer flanges comprises an elongated lip portion adjacent said rear retainer slot for guiding said corresponding side flange of said rear wall into said rear retainer slot during the assembly of each of said side walls to said corresponding back wall.

3. The invention according to claim 2 in which each of said lip portions comprises a lip flange projecting inboard.

4. The invention according to claim 1 in which each of said top retainer flanges comprises a top lip portion adjacent said opening in said top retainer slot for engaging said bottom surface of said top wall in said assembled position.

5. The invention according to claim 4 in which each of said top lip portions comprises a top lip flange projecting inward spaced from and parallel to each corresponding top flange for receiving said top wall.

6. The invention according to claim 1 in which a plurality of vertically spaced slots in said front connector strips opening forward, a plurality of additional shoulder studs projecting inboard and spaced vertically along each of said side frame members having the same spacing as said slots, each of said slots being adapted to receive a corresponding shoulder stud for retaining said door frame on said front connector strips.

7. The invention according to claim 6 in which each of said key-ways is located at the upper end portion of said corresponding side frame member, each of said key-ways having a larger end portion above a smaller end portion.

8. The invention according to claim 1 in which said door frame has a transverse bottom sill member having a transverse upper projecting top flange, a plurality of vertically spaced shelf retaining tongues formed upon the inside surface of said back wall and projecting upward, a bottom shelf having front and rear depending flanges, said front flange being adapted to be received over said top flange of said bottom sill member and said rear flange of said shelf being adapted to be received on one of said tongues.

9. The invention according to claim 8 further comprising a plurality of vertically spaced shelf retainer tongues mounted on the inside surface of each of said side walls and projecting upward, one or more shelves having depending rear and side flanges, said rear and side flanges being adapted to be received on corresponding shelf retaining tongues at a pre-determined level.

10. The invention according to claim 9 further comprising a pair of front doors having outer edges and inner edges, hinge means connecting said outer edges of said doors to said side frame members of said door frame and handle-actuated lock means on one of said doors for cooperating with said other door for locking said doors in a closed position.

* * * * *